US008920266B2

(12) United States Patent
Takeuchi

(10) Patent No.: US 8,920,266 B2
(45) Date of Patent: Dec. 30, 2014

(54) GOLF CLUB SHAFT

(71) Applicant: Dunlop Sports Co., Ltd., Kobe-shi, Hyogo (JP)

(72) Inventor: Hiroyuki Takeuchi, Kobe (JP)

(73) Assignee: Dunlop Sports Co. Ltd., Kobe-Shi (JP)

( * ) Notice: Subject to any disclaimer, the term of this patent is extended or adjusted under 35 U.S.C. 154(b) by 115 days.

(21) Appl. No.: 13/724,940

(22) Filed: Dec. 21, 2012

(65) Prior Publication Data

US 2013/0165250 A1 Jun. 27, 2013

(30) Foreign Application Priority Data

Dec. 26, 2011 (JP) ..... 2011-283699

(51) Int. Cl.
*A63B 53/10* (2006.01)

(52) U.S. Cl.
USPC ..... 473/409

(58) Field of Classification Search
USPC ..... 473/316–323
See application file for complete search history.

(56) References Cited

FOREIGN PATENT DOCUMENTS

| | | | |
|---|---|---|---|
| JP | 2004-57642 | A | 2/2004 |
| JP | 2007-185253 | A | 7/2007 |
| JP | 2009-60983 | A | 3/2009 |
| JP | 2010-63778 | A | 3/2010 |
| JP | 2011-147543 | A | 8/2011 |

*Primary Examiner* — Stephen L. Blau
(74) *Attorney, Agent, or Firm* — Birch, Stewart, Kolasch & Birch, LLP

(57) ABSTRACT

A shaft full length is defined as Ls and a distance between a tip end of the shaft and a center of gravity G of the shaft is defined as Lg. In a shaft 6, Lg/Ls is 0.54 or greater and 0.65 or less. A shaft weight Ws is 50 g or greater and 85 g or less. The shaft 6 has at least three bias layer pairs. One bias layer pair of the three bias layer pairs is a pitch-containing bias layer pair having a pitch based carbon fiber. Two bias layer pairs of the three bias layer pairs are PAN-containing bias layer pairs having a PAN based carbon fiber. Preferably, the PAN-containing bias layer pairs are located outside and inside the pitch-containing bias layer pair.

16 Claims, 12 Drawing Sheets

GOLF CLUB SHAFT

The present application claims priority on Patent Application No. 2011-283699 filed in JAPAN on Dec. 26, 2011, the entire contents of which are hereby incorporated by reference.

BACKGROUND OF THE INVENTION

1. Field of the Invention

The present invention relates to a golf club shaft.

2. Description of the Related Art

A so-called carbon shaft has been widely used. In the carbon shaft, CFRP (carbon fiber reinforced plastic) is normally used. The fiber reinforced resin has an excellent specific strength and specific rigidity. The carbon shaft can contribute to the weight saving of a club. The weight saving of the club can contribute to the increase of a flight distance.

A bias layer is normally provided in the carbon shaft. The bias layer can enhance torsional rigidity. The directional stability of a hit ball can be improved by the improvement of the torsional rigidity.

Japanese Patent Application Laid-Open No. 2011-147543 (FIGS. 5, 6 and 8 or the like) discloses a shaft having a first bias layer, a second bias layer, and a third bias layer. Japanese Patent Application Laid-Open No. 2010-63778 (FIGS. 5 and 6 or the like) discloses a shaft having a first bias layer, a second bias layer, and a third bias layer. Japanese Patent Application Laid-Open No. 2009-60983 discloses a shaft having at least two bias set layers. Japanese Patent Application Laid-Open No. 2007-185253 (FIG. 2 or the like) discloses a shaft having a first full length layer II, a second full length layer III, and a third full length layer IV. Japanese Patent Application Laid-Open No. 2004-57642 (Claim 1, FIG. 2 or the like) discloses a shaft having a reinforced prepreg sheet as an outermost layer located on a shaft small diameter side.

SUMMARY OF THE INVENTION

It was found that uncomfortable vibration and impact are apt to be caused in the carbon shaft in hitting. The carbon shaft is lightweight. When the shaft is light, the impact becomes stronger, or is hardly attenuated. Therefore, a golf player is considered to be apt to feel the uncomfortable vibration. The vibration may apply a load to the golf player's elbow and shoulder or the like.

The present inventors found that a novel laminated constitution is effective in suppressing the vibration.

It is an object of the present invention to provide a golf club shaft which is likely to be swung easily and has excellent vibration absorbability.

When a shaft full length is defined as Ls and a distance between a tip end of the shaft and a center of gravity G of the shaft is defined as Lg in a golf club shaft according to the present invention, Lg/Ls is 0.54 or greater and 0.65 or less. Preferably, a shaft weight Ws is 50 g or greater and 85 g or less. Preferably, the shaft has at least three bias layer pairs. Preferably, one bias layer pair of the three bias layer pairs is a pitch-containing bias layer pair having a pitch based carbon fiber. Preferably, two bias layer pairs of the three bias layer pairs are PAN-containing bias layer pairs having a PAN based carbon fiber.

Preferably, the PAN-containing bias layer pairs are located outside and inside the pitch-containing bias layer pair.

Preferably, the one bias layer pair of the three bias layer pairs is a butt partial layer.

Preferably, the butt partial layer is the PAN-containing bias layer pair.

Preferably, the two bias layer pairs of the three bias layer pairs are full length layers.

Preferably, the three bias layer pairs are brought into contact with each other.

Easiness to swing and vibration absorbability can be attained.

BRIEF DESCRIPTION OF THE DRAWINGS

FIG. 2 is also a developed view of a shaft of example 1;

FIG. 3 is also a developed view of a shaft of example 2;

FIG. 4 is also a developed view of a shaft of example 3;

DESCRIPTION OF THE PREFERRED EMBODIMENTS

Figure 1:
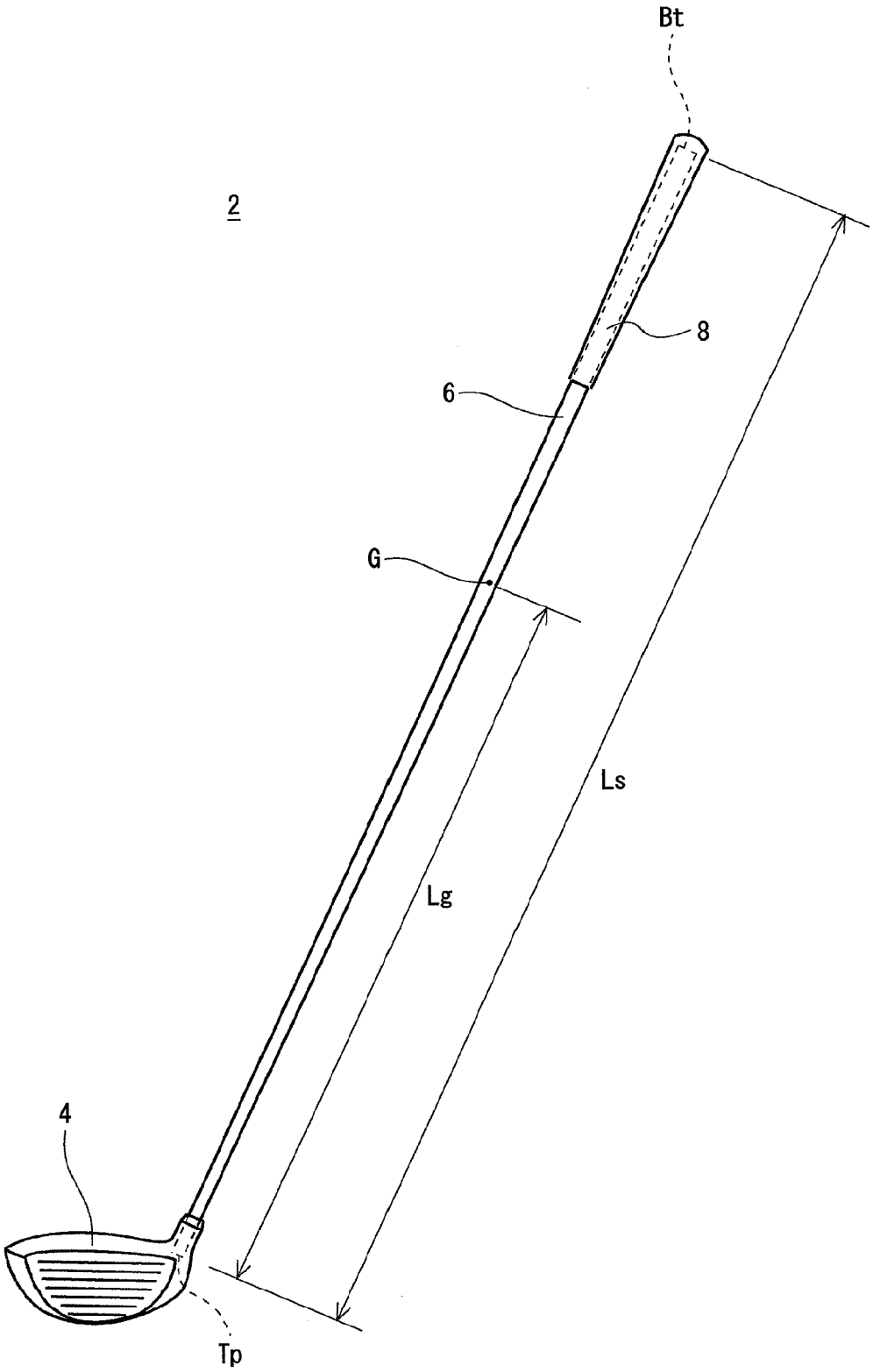
FIG. 1 shows a golf club provided with a shaft according to a first embodiment of the present invention.

Hereinafter, the present invention will be described in detail based on the preferred embodiments with appropriate references to the accompanying drawings.

The term "layer" and the term "sheet" are used in the present application. The "layer" is termed after being wound. On the other hand, the "sheet" is termed before being wound. The "layer" is formed by winding the "sheet". That is, the wound "sheet" forms the "layer". In the present application, the same reference numeral is used in the layer and the sheet. For example, a layer formed by a sheet a1 is defined as a layer a1.

In the present application, an "inside" means an inside in a radial direction of a shaft. In the present application, an "outside" means an outside in the radial direction of the shaft.

In the present application, an "axis direction" means an axis direction of the shaft.

In the present application, an angle Af and an absolute angle θa are used for the angle of a fiber to the axis direction. The angle Af is a plus or minus angle. The absolute angle θa is the absolute value of the angle Af. In other words, the absolute angle θa is the absolute value of an angle between the axis direction and the direction of the fiber. For example, "the absolute angle θa is equal to or less than 10 degrees" means that "the angle Af is −10 degrees or greater and +10 degrees or less".

First Embodiment

FIG. 1 shows a golf club 2 provided with a golf club shaft 6 according to a first embodiment of the present invention.

The golf club 2 is provided with a head 4, a shaft 6, and a grip 8. The head 4 is provided at the tip part of the shaft 6. The grip 8 is provided at the back end part of the shaft 6. The head 4 and the grip 8 are not restricted. Examples of the head 4 include a wood type golf club head, a hybrid type golf club head, a utility type golf club head, an iron type golf club head, and a putter head.

The head 4 of the embodiment is a wood type golf club head. A longer shaft tends to exhibit a vibration absorbing effect. In this respect, the wood type golf club head, the hybrid type golf club head, and the utility type golf club head are preferable as the head 4. A hollow head has a large moment of inertia. An effect of improving a flight distance is stably obtained by a club having a head having a large moment of inertia. In this respect, the head 4 is preferably hollow.

The material of the head 4 is not restricted. Examples of the material of the head 4 include titanium, a titanium alloy, CFRP (carbon fiber reinforced plastic), stainless steel, maraging steel, and soft iron. A plurality of materials can be combined. For example, the CFRP and the titanium alloy can be combined. In respect of lowering the center of gravity of the head, at least a part of a crown may be made of CFRP and at least a part of a sole may be made of a titanium alloy. In respect of a strength, the whole face is preferably made of a titanium alloy.

The shaft 6 includes a laminate of fiber reinforced resin layers. The shaft 6 is a tubular body. The shaft 6 has a hollow structure. As shown in FIG. 1, the shaft 6 has a tip end Tp and a butt end Bt. The tip end Tp is located in the head 4. The butt end Bt is located in the grip 8.

The shaft 6 is a so-called carbon shaft. The shaft 6 is preferably produced by curing a prepreg sheet. In the prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin.

The shaft 6 is manufactured by a so-called sheet winding method. In the prepreg, the matrix resin is in a semicured state. The shaft 6 is obtained by winding and curing the prepreg sheet. The curing means the curing of the semicured matrix resin. The curing is attained by heating. The manufacturing process of the shaft 6 includes a heating process. The heating process cures the matrix resin of the prepreg sheet.

Figure 2:
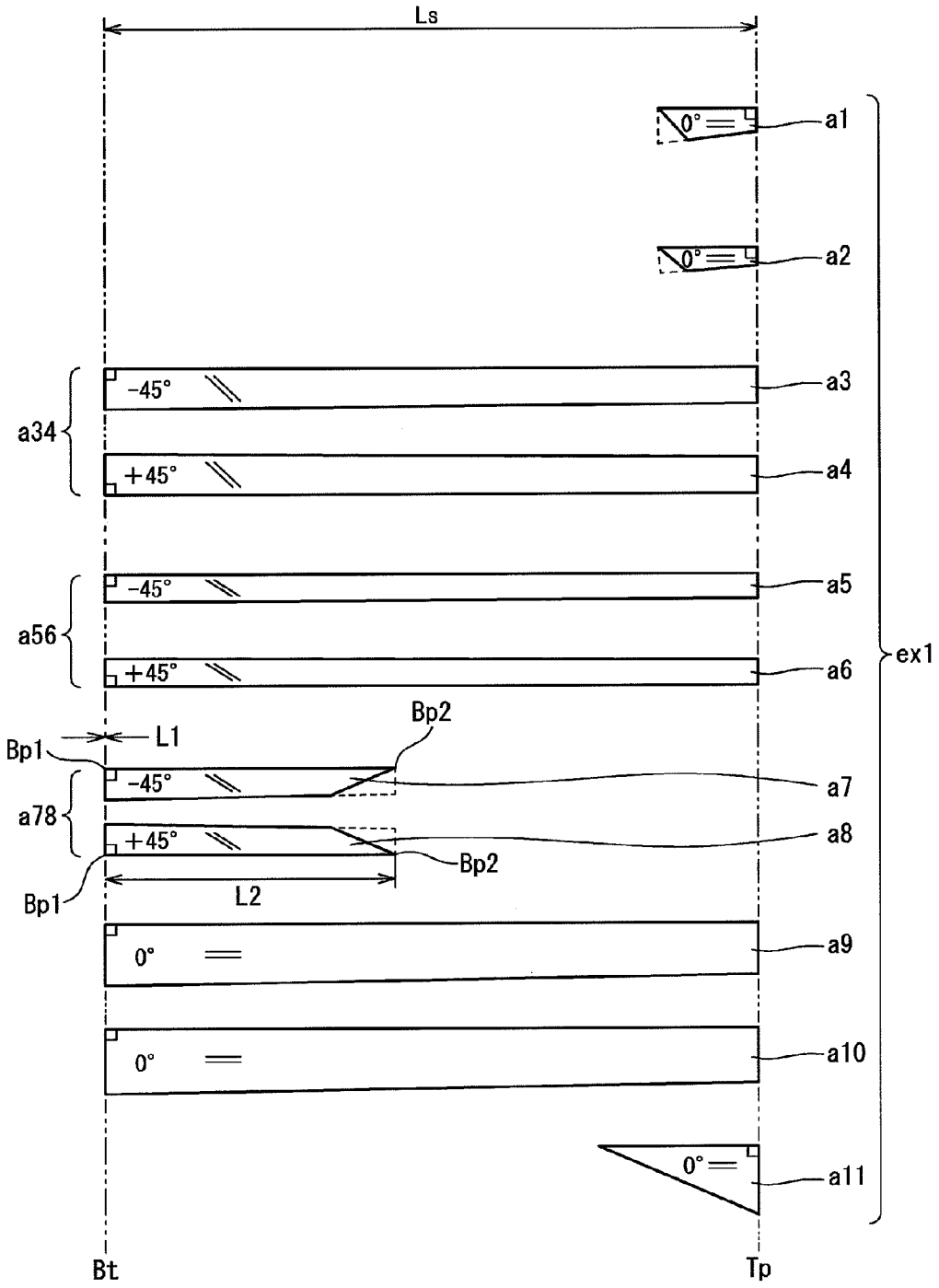
FIG. 2 is a developed view of the shaft according to the first embodiment.

FIG. 2 is a developed view (sheet constitution view) of the prepreg sheets constituting the shaft 6. The shaft 6 includes a plurality of sheets. In the embodiment of FIG. 2, the shaft 6 includes eleven sheets a1 to all. In the present application, the developed view shown in FIG. 2 or the like shows a winding order. The sheets are wound in order from the sheet located on the uppermost side in the developed view. In the developed view of the present application, the horizontal direction of the figure coincides with the axis direction of the shaft. In the developed view of the present application, the right side of the figure is a tip side of the shaft, and the left side of the figure is a butt side of the shaft.

The developed view of the present application shows not only the winding order of each of the sheets but also the disposal of each of the sheets in the axis direction of the shaft. For example, in FIG. 2, one end of the sheet a1 is located at the tip end Tp. For example, in FIG. 2, the other ends of the sheet a7 and the sheet a8 are located at the butt end Bt.

The shaft 6 has a straight layer and a bias layer. The orientation angle of the fiber is described in the developed view of the present application. A sheet described as "0 degree" constitutes the straight layer. The sheet for the straight layer is also referred to as a straight sheet in the present application.

The straight layer is a layer in which the orientation direction of the fiber is substantially 0 degree to the longitudinal direction (axis direction of the shaft) of the shaft. The orientation of the fiber may not be completely set to 0 degree to the axis direction of the shaft by error or the like in winding. Usually, in the straight layer, the absolute angle θa is equal to or less than 10 degrees.

In the embodiment of FIG. 2, the straight sheets are the sheet a1, the sheet a2, the sheet a9, the sheet a10, and the sheet a11. The straight layer is highly correlated with the flexural rigidity and flexural strength of the shaft.

On the other hand, the bias layer is highly correlated with the torsional rigidity and torsional strength of the shaft. Preferably, the bias layer includes a two-sheet pair in which orientation angles of fibers are inclined in opposite directions to each other. In respect of enhancing the torsional rigidity, the absolute angle θa of the bias layer is preferably equal to or greater than 15 degrees, more preferably equal to or greater than 25 degrees, and still more preferably equal to or greater than 40 degrees. In respect of enhancing the torsional rigidity, the absolute angle θa of the bias layer is preferably equal to or less than 60 degrees, and more preferably equal to or less than 50 degrees. Typically, the absolute angle θa of the bias layer is set to 45 degrees. In the embodiment, the absolute angle θa is 45 degrees. However, an error of about ±10 degree can be allowed.

In the shaft 6, the sheets constituting the bias layer are the sheet a3, the sheet a4, the sheet a5, the sheet a6, the sheet a7, and the sheet a8. In FIG. 2, the angle Af is described in each sheet. The plus (+) and minus (−) in the angle Af show that the fibers of bias sheets are inclined in opposite directions to each other. In the present application, the sheet for the bias layer is also merely referred to as a bias sheet.

In the embodiment of FIG. 2, the angle of the sheet a3 is −45 degrees and the angle of the sheet a4 is +45 degrees. However, conversely, it should be appreciated that the angle of the sheet a3 may be +45 degrees and the angle of the sheet a4 may be −45 degrees.

The shaft 6 may have a hoop layer although the hoop layer is not employed in the embodiment of FIG. 2. Preferably, the absolute angle θa in the hoop layer is substantially 90 degrees. However, the orientation direction of the fiber to the axis direction of the shaft may not be completely set to 90 degrees by an error or the like in winding. Usually, in the hoop layer, the absolute angle θa is 80 degrees or greater and 90 degrees or less.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is applied to one surface of the prepreg sheet, and the resin film is applied to the other surface of the prepreg sheet. Hereinafter, the surface to which the mold release paper is applied is also referred to as "a surface of a mold release paper side", and the surface to which the resin film is applied is also referred to as "a surface of a film side".

In the developed view of the present application, the surface of the film side is the front side. That is, in the developed view of the present application, the front side of the figure is the surface of the film side, and the back side of the figure is the surface of the mold release paper side. For example, in FIG. 2, the direction of the fiber of the sheet a3 is the same as that of the sheet a4. However, in the case of the stacking to be described later, the sheet a4 is reversed. As a result, the directions of the fibers of the sheets a3 and a4 are opposite to each other. Therefore, in the state after being wound, the directions of the fibers of the sheets a3 and a4 are opposite to each other. In light of this point, in FIG. 2, the direction of the fiber of the sheet a3 is described as "−45 degrees", and the direction of the fiber of the sheet a4 is described as "+45 degrees".

In order to wind the prepreg sheet, the resin film is previously peeled. The surface of the film side is exposed by peeling the resin film. The exposed surface has tacking property (tackiness). The tacking property is caused by the matrix resin. That is, since the matrix resin is in a semicured state, the tackiness is developed. Next, the edge part of the exposed surface of the film side (also referred to as a winding start edge part) is applied to a wound object. The winding start edge part can be smoothly applied by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is previously peeled. Next, the winding start edge part is applied to the wound object, and the mold release paper is then peeled. That is, the resin film is previously peeled. After the winding start edge part is applied to the wound object, the mold release paper is peeled. The procedure suppresses wrinkles and winding fault of the sheet. This is because the sheet to which the mold release paper is applied is supported by the mold release paper, and hardly causes wrinkles. The mold release paper has flexural rigidity higher than that of the resin film.

In the embodiment of FIG. 2, a bias sheet pair is used. Preferably, two bias sheets constituting the bias sheet pair are stuck before winding.

In the embodiment of FIG. 2, three bias sheet pairs are used. A first bias sheet pair a34 includes the sheet a3 and the sheet a4. A second bias sheet pair a56 includes the sheet a5 and the sheet a6. A third bias sheet pair a78 includes the sheet a7 and the sheet a8. In the embodiment, layers other than the bias layer are not interposed among the three bias layer pairs.

Preferably, the circumferential position of the sheet a3 is made different from that of the sheet a4. The difference is a half circle (180 degrees±10 degrees), for example. The difference can be attained by deviating the sheets from each other in sticking. Similarly, preferably, the circumferential position of the sheet a5 is made different from that of the sheet a6. Similarly, preferably, the circumferential position of the sheet a7 is made different from that of the sheet a8.

As described above, in the present application, the sheet and the layer are classified by the orientation angle of the fiber. Furthermore, in the present application, the sheet and the layer are classified by the length of the axis direction of the shaft.

In the present application, a layer disposed all over in the axis direction of the shaft is referred to as a full length layer. In the present application, a sheet disposed all over in the axis direction of the shaft is referred to as a full length sheet. The wound full length sheet forms the full length layer.

On the other hand, in the present application, a layer partially disposed in the axis direction of the shaft is referred to as a partial layer. In the present application, a sheet partially disposed in the axis direction of the shaft is referred to as a partial sheet. The wound partial sheet forms the partial layer.

In the present application, the full length layer which is the straight layer is also referred to a full length straight layer. In the embodiment of FIG. 2, the full length straight layers are a layer a9 and a layer a10. In the embodiment, all the full length straight layers are located outside the outermost bias layer pair.

In the present application, the partial layer which is the straight layer is also referred to a partial straight layer. In the embodiment of FIG. 2, the partial straight layers are a layer a1, a layer a2, and a layer a11.

In the present application, the full length layer which is the bias layer is also referred to as a full length bias layer. In the embodiment of FIG. 2, the full length bias layers are a layer a3, a layer a4, a layer a5, and a layer a6.

In the present application, the bias layer pair which is the full length layer is also referred to as a full length bias layer pair. In the embodiment of FIG. 2, the full length bias layer pair is a layer a34 and a layer a56.

In the present application, the bias layer pair which is the partial layer is also referred to as a partial bias layer pair. In the embodiment of FIG. 2, the partial bias layer pair is a layer a78.

In the present application, the full length layer which is the hoop layer is referred to as a full length hoop layer. The hoop layer does not exist in FIG. 2.

The term "butt partial layer" is used in the present application. The butt partial layer is one aspect of the partial layer. Examples of the butt partial layer include a butt straight layer, a butt hoop layer, and a butt bias layer.

The embodiment of FIG. 2 has the butt bias layer. The butt bias layer is a layer a7 and a layer a8. The embodiment of FIG. 2 has the butt bias layer pair. The butt bias layer pair is the layer a78.

In the embodiment, the shaft 6 is produced by the sheet winding method using the sheets shown in FIG. 2.

Hereinafter, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

A plurality of sheets is stacked in the stacking process. In the embodiment, the sheet a3 and sheet a4 are stuck; the sheet a5 and the sheet a6 are stuck; and the sheet a7 and the sheet a8 are stuck. Thus, the sheets constituting the bias layer pair are stuck in the embodiment.

In the stacking process, heating or a press may be used. More preferably, the heating and the press are used in combination. In a winding process to be described later, the deviation of the sheet may be produced during the winding operation of the bias sheet pair. The deviation reduces winding accuracy. The heating and the press improve an adhesive force between the sheets. The heating and the press suppress the deviation between the sheets in the winding process.

In respect of enhancing the adhesive force between the sheets, a heating temperature in the stacking process is preferably equal to or greater than 30° C., and more preferably equal to or greater than 35° C. When the heating temperature is too high, the curing of the matrix resin may be progressed, to reduce the tackiness of the sheet. The reduction of the tackiness reduces adhesion between the bias sheet pair and the wound object. The reduction of the adhesion may allow the generation of wrinkles, to generate the deviation of a winding position. In this respect, the heating temperature in the stacking process is preferably equal to or less than 60° C., more preferably equal to or less than 50° C., and still more preferably equal to or less than 40° C.

In respect of enhancing the adhesive force between the sheets, a heating time in the stacking process is preferably equal to or greater than 20 seconds, and more preferably equal to or greater than 30 seconds. In respect of maintaining the tackiness of the sheet, the heating time in the stacking process is preferably equal to or less than 300 seconds.

In respect of enhancing the adhesive force between the sheets, a press pressure in the stacking process is preferably equal to or greater than 300 g/cm$^2$, and more preferably equal to or greater than 350 g/cm$^2$. When the press pressure is excessive, the prepreg may be crushed. In this case, the thickness of the prepreg is made thinner than a designed value. In respect of thickness accuracy of the prepreg, the press pressure in the stacking process is preferably equal to or less than 600 g/cm$^2$, and more preferably equal to or less than 500 g/cm$^2$.

In respect of enhancing the adhesive force between the sheets, a press time in the stacking process is preferably equal to or greater than 20 seconds, and more preferably equal to or greater than 30 seconds. In respect of the thickness accuracy of the prepreg, the press time in the stacking process is preferably equal to or less than 300 seconds.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The sheets for stacking are wound in a state where the sheets are stacked.

A winding body is obtained by the winding process. The winding body is obtained by wrapping the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The wrapping tape is wrapped while tension is applied to the wrapping tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not restricted. However, the process of removing the wrapping tape is preferably performed after the process of extracting the mandrel in respect of improving the efficiency of the process of removing the wrapping tape.

(7) Process of Cutting Both Ends

The both end parts of the cured laminate are cut in the process. The cutting flattens the end face of the tip end Tp and the end face of the butt end Bt. The developed view of the present application is drawn with a portion cut in the process of cutting the both ends removed for the sake of simplicity. In fact, in the cutting process, a sheet having a size also including the portion cut in the process of cutting both the ends is cut.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to flatten the surface of the cured laminate.

(9) Coating Process

The cured laminate after the polishing process is subjected to coating.

The shaft 6 is obtained in the processes.

The shaft 6 has a center of gravity G. The center of gravity G is a center of gravity of a shaft simple body. The center of gravity G of the shaft is shown in FIG. 1. A shaft full length is shown by a double-pointed arrow Ls in FIG. 1. A distance between the tip end Tp and the center of gravity G of the shaft is shown by a double-pointed arrow Lg in FIG. 1. The shaft full length Ls and the distance Lg are measured along the axis direction.

[Lg/Ls]

Lg/Ls is considered in the present application. A swing weight (swing balance) is lightened by increasing Lg/Ls, and thereby the easiness to swing can be improved. The easiness to swing can be improved without lightening a head weight by increasing Lg/Ls. Therefore, the set range of the head weight is extended, and thereby a degree of freedom of design of the head can be improved. The improvement of the degree of freedom of design can contribute to the lowering of the center of gravity of the head, for example. In these respects, Lg/Ls is preferably equal to or greater than 0.54, more preferably equal to or greater than 0.55, and still more preferably equal to or greater than 0.56.

When Lg/Ls is excessive, it is necessary to make the head weight heavier in order to set the swing weight to a normal value. When the head weight is excessive even if the swing weight is normal, it is difficult to swing the golf club. In this respect, Lg/Ls is preferably equal to or less than 0.65, more preferably equal to or less than 0.64, and still more preferably equal to or less than 0.63.

[Shaft Full Length Ls]

Because a pitch-containing bias layer pair can be lengthened in a long shaft, the long shaft advantageously exhibits vibration absorbability. In this respect, the shaft full length Ls is preferably equal to or greater than 41 inches, more preferably equal to or greater than 42 inches, still more preferably equal to or greater than 43 inches, still more preferably equal to or greater than 44 inches, and particularly preferably equal to or greater than 45 inches. In respect of the easiness to swing and the golf rule, the shaft full length Ls is preferably equal to or less than 47 inches, more preferably equal to or less than 46.5 inches, and still more preferably equal to or less than 46 inches.

Examples of means for adjusting Lg/Ls include the following items (a1) to (a8):

(a1) increase or decrease of number of windings of the butt partial layer;

(a2) increase or decrease of a thickness of the butt partial layer;

(a3) increase or decrease of an axial length of the butt partial layer;

(a4) a shape of the bias layer (adjustment of the number of windings on the tip side and the number of windings on the butt side);

(a5) increase or decrease of number of windings of a tip partial layer;

(a6) increase or decrease of a thickness of the tip partial layer;

(a7) increase or decrease of an axial length of the tip partial layer; and (a8) increase or decrease of a taper ratio of the shaft.

Lg/Ls is easily adjusted by the existence of the butt partial layer.

[Shaft Weight Ws]

In respect of securing a strength while providing the three bias layer pairs, the shaft weight Ws is preferably equal to or greater than 50 g, more preferably equal to or greater than 52 g, still more preferably equal to or greater than 55 g, yet still more preferably equal to or greater than 60 g, and yet still more preferably equal to or greater than 62 g. In respect of the easiness to swing, the shaft weight Ws is preferably equal to or less than 85 g, more preferably equal to or less than 83 g, and still more preferably equal to or less than 80 g.

Preferably, at least three bias layer pairs are provided. The shaft 6 of the embodiment has three bias layer pairs a34, a56, and a78. In respect of the weight saving, the number of the bias layer pairs is preferably equal to or less than 5, more preferably equal to or less than 4, and most preferably 3.

In respect of the weight saving, the number of the full length bias layer pairs is preferably equal to or less than 4, more preferably equal to or less than 3, and most preferably 2. In the embodiment, the number of the full length bias layer pairs is 2. In the embodiment, the full length bias layer pairs are the pair a34 and the pair a56.

Preferably, at least one bias layer pair is the pitch-containing bias layer pair having a pitch based carbon fiber. In the embodiment, the bias layer pair a56 is the pitch-containing bias layer pair.

The pitch based carbon fiber can temporarily take a structure where atoms are deviated in the molecular structure thereof when a force is applied to the pitch based carbon fiber. The vibration absorbability can be caused by the structure. The vibration absorbability is improved by providing the pitch-containing bias layer pair.

In the pitch based carbon fiber, the elastic modulus can be set to be equal to or greater than 55 t/mm$^2$. The degree of freedom of design of the elastic modulus of the bias layer is improved by using the pitch-containing bias layer pair. The high elastic modulus is useful for the weight saving of the shaft while enhancing the torsional rigidity.

A pitch based prepreg used for the pitch-containing bias layer pair contains the pitch based carbon fiber. The carbon fiber of the pitch based prepreg may be only the pitch based carbon fiber, or may contain a carbon fiber other than the pitch based carbon fiber. In the embodiment, a hybrid type prepreg is used as the pitch based prepreg. In the hybrid type prepreg, a PAN based carbon fiber and the pitch based carbon fiber are used in combination. Specifically, the PAN based carbon fiber and the pitch based carbon fiber are alternately arranged. Since the hybrid type prepreg has the PAN based carbon fiber having a high strength and the pitch based carbon fiber having vibration absorbability and high elasticity, the hybrid type prepreg can have these characteristics.

In respect of enhancing the advantage of the pitch-containing bias layer pair, the pitch-containing bias layer pair is preferably the full length layer. The pitch based carbon fiber is disposed over the full length of the shaft, and thereby the pitch based carbon fiber exists between the head generating vibration and the grip to which the vibration is transmitted. Therefore, the generated vibration and the vibration transmitted to hands are effectively suppressed to enhance the vibration absorbability. Also in the embodiment, the pitch-containing bias layer pair a34 is the full length layer.

Preferably, at least two bias layer pairs are the PAN-containing bias layer pairs having the PAN based carbon fiber. Since the PAN-containing bias layer pair has the PAN based carbon fiber, the PAN-containing bias layer pair has an excellent strength. A PAN based prepreg is comparatively inexpensive. In these respects, the carbon fiber contained in the PAN-containing bias layer pair is preferably only the PAN based carbon fiber.

Preferably, at least one bias layer pair is the butt partial layer. The center of gravity G of the shaft can be located closer to the butt end Bt by the constitution, and thereby Lg/Ls can be increased. The excessive flexural rigidity of a butt portion can be prevented by using the bias layer as the butt partial layer. This can be useful for suppressing uncomfortable vibration transmitted to the hands. In the embodiment, the bias layer pair a78 is the butt partial layer.

At least two bias layer pairs are preferably the full length layers. The torsional rigidity is effectively suppressed by the constitution. A degree of freedom of design of the torsional rigidity and a torsional rigidity distribution is improved by using a plurality of full length bias layer pairs. In the embodiment, the two bias layer pairs (a34, a56) are provided.

Preferably, one or more full length PAN-containing bias layer pairs and one or more full length pitch-containing bias layer pairs are provided. The degree of freedom of the design of the torsional rigidity and the torsional rigidity distribution is further improved by the constitution. The shaft 6 of the embodiment has the full length pitch-containing bias layer pair a34 and the full length PAN-containing bias layer pair a56.

Preferably, three bias layer pairs are brought into contact with each other. Also in the embodiment, the bias layer pair a34, the bias layer pair a56, and the bias layer pair a78 are brought into contact with each other. The bias layer pairs are brought into contact with each other, and thereby the interaction of the bias layer pairs is generated. The interaction is considered to contribute to vibrational absorption. Particularly, when the PAN-containing bias layer pair and the pitch-containing bias layer pair are brought into contact with each other, the vibration is considered to be efficiently transmitted to the pitch-containing bias layer pair from the PAN-containing bias layer pair. The vibration transmitted to the pitch-containing bias layer pair is estimated to be efficiently absorbed based on the molecular structure of the pitch based carbon fiber.

The butt partial layer may be the PAN-containing bias layer pair, or may be the pitch-containing bias layer pair. In the embodiment, the butt partial layer a78 is the PAN-containing bias layer pair. The strength of the butt portion is effectively enhanced by using the PAN based carbon fiber for the butt partial layer.

Figure 3:
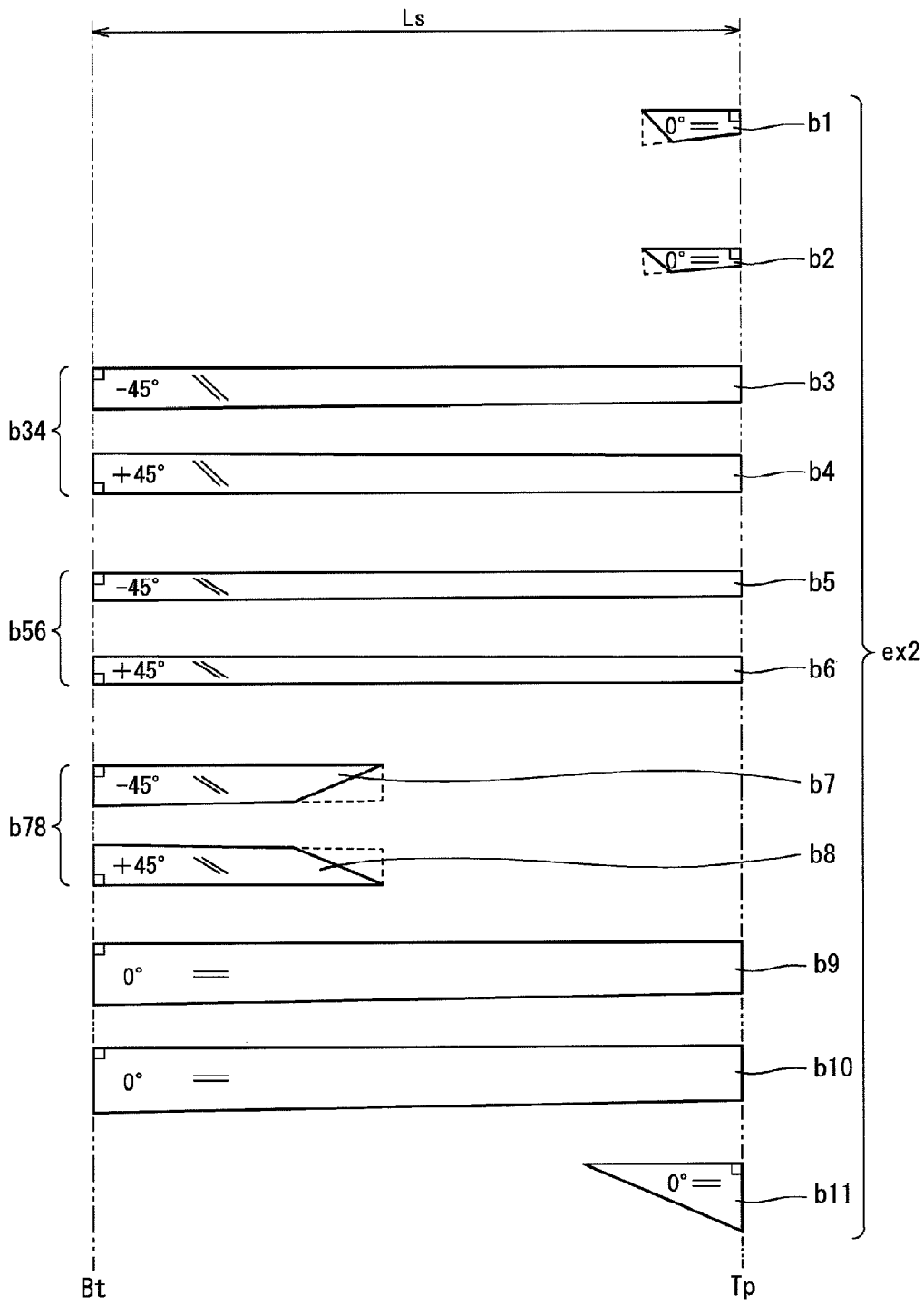
FIG. 3 is a developed view of a shaft according to a second embodiment.

FIG. 3 is a developed view of a shaft according to a second embodiment. In the second embodiment, the number of windings of a bias layer pair b78 which is the butt partial layer is greater than that of the first embodiment of FIG. 2. Therefore, Lg/Ls can be further increased.

Figure 4:
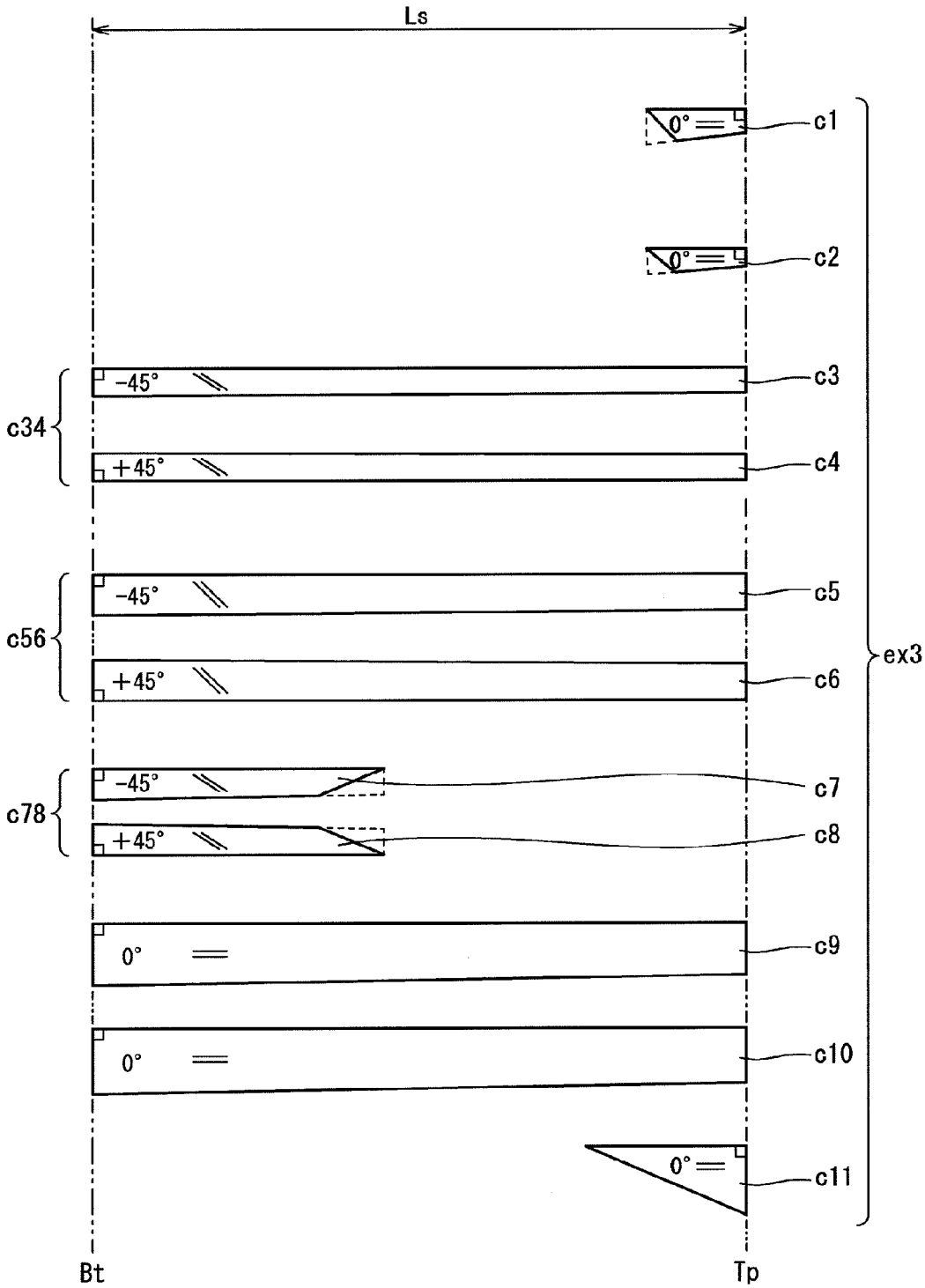
FIG. 4 is a developed view of a shaft according to a third embodiment.

FIG. 4 is a developed view of a shaft according to a third embodiment. In the third embodiment, a bias layer pair c34 is a PAN-containing bias layer pair; a bias layer pair c56 is a pitch-containing bias layer pair; and a bias layer pair c78 is a PAN-containing bias layer pair. Thus, in the embodiment, a bias layer pair is disposed in order of PAN-pitch-PAN. That is, the pitch-containing bias layer pair is sandwiched between the PAN-containing bias layer pairs.

In the third embodiment, the PAN-containing bias layer pairs are located outside and inside the pitch-containing bias layer pair c56. That is, the PAN-containing bias layer pair c78 is located outside the pitch-containing bias layer pair c56, and the PAN-containing bias layer pair c34 is located inside the pitch-containing bias layer pair c56. The three bias layer pairs c34, c56, and c78 are brought into contact with each other.

As shown in data of examples to be described later, it was found that the constitution of the third embodiment can further enhance the vibration absorbability. The reason is unclear. However, it is estimated that this is because both the vibration from the outer PAN-containing bias layer pair c78 and the vibration from the inner PAN-containing bias layer pair c34 are likely be transmitted to the pitch-containing bias layer pair c56. That is, both the following (transmission a) and (transmission b) are estimated to be efficient:

(transmission a) vibration transmission to the pitch-containing bias layer pair c56 from the outer PAN-containing bias layer pair c78; and (transmission b) vibration transmission to the pitch-containing bias layer pair c56 from the inner PAN-containing bias layer pair c34.

The vibration is estimated to be efficiently collected to the pitch-containing bias layer pair c56 by the (transmission a) and the (transmission b). Furthermore, the collected vibration is estimated to be efficiently absorbed by the molecular structure of the pitch carbon fiber. Furthermore, since the three bias layer pairs c34, c56, and c78 are brought into contact with each other, it is considered that the (transmission a) and the (transmission b) can be further improved.

[Fiber Elastic Modulus of Pitch-Containing Bias Layer Pair]

In respect of enhancing the directional stability of a hit ball, the fiber elastic modulus of the pitch-containing bias layer pair is preferably equal to or greater than 45 t/mm$^2$, and more preferably equal to or greater than 50 t/mm$^2$. In respect of suppressing too rigid hitting feeling, the fiber elastic modulus of the pitch-containing bias layer pair is preferably equal to or less than 80 t/mm$^2$, and more preferably equal to or less than 70 t/mm$^2$. In the case of the hybrid type prepreg, the fiber elastic modulus is a weighted average value in light of the use rate of the fiber.

[Shaft Torque]

In respect of suppressing the too rigid hitting feeling, the shaft torque is preferably equal to or greater than 2.4 degrees, more preferably equal to or greater than 2.6 degrees, and still more preferably equal to or greater than 2.8 degrees. In respect of the directional stability of the hit ball, the shaft torque is preferably equal to or less than 4.4 degrees, more preferably equal to or less than 4.2 degrees, and still more preferably equal to or less than 4.0 degrees.

[Torsional Rigidity GIb]

In the present application, a GI value in a point separated by 890 mm from the tip end Tp is defined as GIb. When the torsional rigidity GIb is too small, the hitting feeling is too soft in a golf player having a fast head speed. In this respect, the torsional rigidity GIb is preferably equal to or greater than 24 N·m$^2$, more preferably equal to or greater than 26 N·m$^2$, and still more preferably equal to or greater than 29 N·m$^2$. In respect of suppressing the too rigid hitting feeling to enhance a torsional destruction strength, the torsional rigidity GIb is preferably equal to or less than 59 N·m$^2$, more preferably equal to or less than 57 N·m$^2$, and still more preferably equal to or less than 54 N·m$^2$.

[Torsional Rigidity GIt]

In the present application, a GI value in a point separated by 90 mm from the tip end Tp is defined as GIt. When the torsional rigidity GIt is too small, the hitting feeling is too soft in the golf player having a fast head speed. In this respect, the torsional rigidity GIt is preferably equal to or greater than 5.4 N·m$^2$, more preferably equal to or greater than 5.9 N·m$^2$, and still more preferably equal to or greater than 6.4 N·m$^2$. In respect of suppressing the too rigid hitting feeling to enhance the torsional destruction strength, the torsional rigidity GIt is preferably equal to or less than 8.8 N·m$^2$, more preferably equal to or less than 8.3 N·m$^2$, and still more preferably equal to or less than 7.8 N·m$^2$.

[GIb/GIt]

When GIb/GIt is too small, the hitting feeling is too soft in the golf player having a fast head speed. When GIb/GIt is too small, the solid contact with the ball is apt to be reduced. That is, when GIb/GIt is too small, the face is apt to be opened at the impact. The opening of the face reduces the flight distance. In these respects, GIb/GIt is preferably equal to or greater than 5, more preferably equal to or greater than 5.5, and still more preferably equal to or greater than 6. In light of the limit of the degree of freedom of design, GIb/GIt is normally equal to or less than 9.

[Butt Side End Position Bp1 of Butt Partial Layer, and Distance L1]

The butt side end position of the butt partial layer is shown by reference numeral Bp1 in FIG. 2. In light of a position grasped by the golf player, the influence of the vicinity of the butt end Bt of the shaft on club performance is small. Therefore, a distance L1 between the butt end Bt and the position Bp1 may be set to be equal to or greater than 10 mm, further equal to or greater than 20 mm, and further equal to or greater than 30 mm. In respect of locating the center of gravity G of the shaft closer to the butt, the distance L1 is preferably equal to or less than 100 mm, and more preferably equal to or less than 50 mm. The distance L1 may be 0 mm as shown in the embodiment of FIG. 2.

[Tip Side End Position Bp2 of Butt Partial Layer, and Distance L2]

The tip side end position of the butt partial layer is shown by reference numeral Bp2 in FIG. 2. In respect of locating the center of gravity G of the shaft on the butt side, a distance L2 between the butt end Bt and the position Bp2 is preferably equal to or less than 550 mm, more preferably equal to or less than 540 mm, still more preferably equal to or less than 535 mm, and yet still more preferably equal to or less than 530 mm. In respect of locating the center of gravity G of the shaft on the butt side, the distance L2 is preferably equal to or greater than 300 mm, more preferably equal to or greater than 350 mm, and still more preferably equal to or greater than 400 mm.

[Grip End MI]

The excessive weight saving of the shaft reduces a strength. The excessive weight saving of the head reduces a coefficient of restitution. In this respect, the grip end MI of the club is preferably equal to or greater than $2400\times10^3$ (g·cm$^2$), and more preferably equal to or greater than $2500\times10^3$ (g·cm$^2$). In respects of the easiness to swing and the head speed, the grip end MI is preferably equal to or less than $3200\times10^3$ (g·cm$^2$), and more preferably equal to or less than $3100\times10^3$ (g·cm$^2$). A method for measuring the grip end MI will be described later.

[Swing Balance (14-Inch Type)]

The excessive weight saving of the head reduces the coefficient of restitution. In this respect, the swing balance is preferably equal to or greater than C9, and more preferably equal to or greater than D0. In respect of the easiness to swing and the head speed, the swing balance is preferably equal to or less than D5, and more preferably equal to or less than D4.

In addition to an epoxy resin, a thermosetting resin other than the epoxy resin and a thermoplastic resin or the like may be also used as the matrix resin of the prepreg sheet. In respect of the shaft strength, the matrix resin is preferably the epoxy resin.

EXAMPLES

Hereinafter, the effects of the present invention will be clarified by examples. However, the present invention should not be interpreted in a limited way based on the description of examples.

The following table 1 is a list of prepregs used in examples and comparative examples. CF in Table 1 means a carbon fiber. E5526D-10H is the above-mentioned hybrid type prepreg. In example 1 or the like to be described later, E5526D-10H constitutes a pitch-containing bias layer pair.

TABLE 1

Used prepregs

| Manufacturer | Part number | | CF weight basis (g/m$^2$) | CF kind | CF elastic modulus (t/mm$^2$) | Resin content (wt %) |
|---|---|---|---|---|---|---|
| Mitsubishi Rayon Co., Ltd. | TR350C | 100S | 100 | PAN | 24 | 25 |
| | | 125S | 125 | | | |
| | | 150S | 150 | | | |
| | MRX350C | 100S | 100 | PAN | 30 | 25 |
| | | 125S | 125 | | | |
| | | 150S | 150 | | | |
| | HRX350C | 075S | 75 | PAN | 40 | 25 |
| | | 110S | 100 | | | |
| | | 130S | 125 | | | |
| Toray Industries, Inc. | 2275S | 10 | 100 | PAN | 30 | 24 |
| | 805S | 3 | 30 | PAN | 30 | 40 |
| Nippon Graphite Fiber Corporation | E5526D | 10H | 100 | PAN + Pitch | 55 | 30 |
| Mitsubishi Rayon Co., Ltd. | HRX350C | 075S | 75 | PAN | 40 | 25 |
| | TR350C | 100S | 100 | PAN | 24 | 25 |
| | MRX350C | 150S | 150 | PAN | 30 | 25 |
| | TR350C | 150S | 150 | PAN | 24 | 25 |

Example 1

A shaft of example 1 was obtained as in the shaft 6 of the above-mentioned first embodiment. A developed view of a shaft ex1 according to the example 1 is shown in FIG. 2. Prepregs and PLY numbers (number of windings) used in the example 1 are shown in the following Table 2. The PLY number in a triangular tip reinforced prepreg (sheet a11) means the PLY number in a tip end Tp. The shaft of the example 1 was obtained by the above-mentioned manufacturing method. A head and a grip were attached to the shaft to obtain a club of the example 1. "SRIXON Z-TX2 TOUR loft 9.5 degrees" (trade name) manufactured by Dunlop Sports Limited was used as the head. The weight of the grip was 50 g. The specifications of the shaft and the club are shown in the following Table 10. In the example 1, a distance L1 was set to 0 mm and a distance L2 was set to 535 mm.

TABLE 2

Prepreg constitution of example 1

| Sheet | Part number | | PLY number |
|---|---|---|---|
| a1 | TR350C | 150S | 3 |
| a2 | 2275S | 10 | 1 |
| a3 | E5526D | 10H | 2 |

TABLE 2-continued

Prepreg constitution of example 1

| Sheet | Part number | | PLY number |
|---|---|---|---|
| a4 | E5526D | 10H | 2 |
| a5 | HRX350C | 075S | 1 |
| a6 | HRX350C | 075S | 1 |
| a7 | TR350C | 100S | 1 |
| a8 | TR350C | 100S | 1 |
| a9 | MRX350C | 150S | 2 |
| a10 | MRX350C | 150S | 2 |
| a11 | TR350C | 150S | 5 |

Example 2

A shaft of example 2 was obtained as in the shaft of the above-mentioned second embodiment. A developed view of a shaft ex2 according to the example 2 is shown in FIG. 3. Prepregs and PLY numbers (number of windings) used in the example 2 are shown in the following Table 3. A shaft and a club according to the example 2 were obtained in the same manner as in the example 1 except for above. The specifications of the shaft and the club are shown in the following Table 10. In the example 2, a distance L1 was set to 0 mm, and a distance L2 was set to 535 mm.

TABLE 3

Prepreg constitution of example 2

| Sheet | Part number | | PLY number |
|---|---|---|---|
| b1 | TR350C | 150S | 3 |
| b2 | 2275S | 10 | 1 |
| b3 | E5526D | 10H | 2 |
| b4 | E5526D | 10H | 2 |
| b5 | HRX350C | 075S | 1 |
| b6 | HRX350C | 075S | 1 |
| b7 | TR350C | 100S | 2 |
| b8 | TR350C | 100S | 2 |
| b9 | MRX350C | 125S | 2 |

TABLE 3-continued

| Prepreg constitution of example 2 | | | |
|---|---|---|---|
| Sheet | Part number | | PLY number |
| b10 | MRX350C | 150S | 2 |
| b11 | TR350C | 125S | 5 |

Example 3

A shaft of example 3 was obtained as in the shaft of the above-mentioned third embodiment. A developed view of a shaft ex3 according to the example 3 is shown in FIG. 4. Prepregs and PLY numbers (number of windings) used in the example 3 are shown in the following Table 4. A shaft and a club according to example 3 were obtained in the same manner as in the example 1 except for above. The specifications of the shaft and the club are shown in the following Table 10. In the example 3, a distance L1 was set to 0 mm, and a distance L2 was set to 535 mm.

TABLE 4

| Prepreg constitution of example 3 | | | |
|---|---|---|---|
| Sheet | Part number | | PLY number |
| c1 | TR350C | 150S | 3 |
| c2 | 2275S | 10 | 1 |
| c3 | HRX350C | 110S | 1 |
| c4 | HRX350C | 110S | 1 |
| c5 | E5526D | 10H | 2 |
| c6 | E5526D | 10H | 2 |
| c7 | TR350C | 100S | 1 |
| c8 | TR350C | 100S | 1 |
| c9 | MRX350C | 150S | 2 |
| c10 | MRX350C | 150S | 2 |
| c11 | TR350C | 125S | 5 |

Example 4

Figure 5:
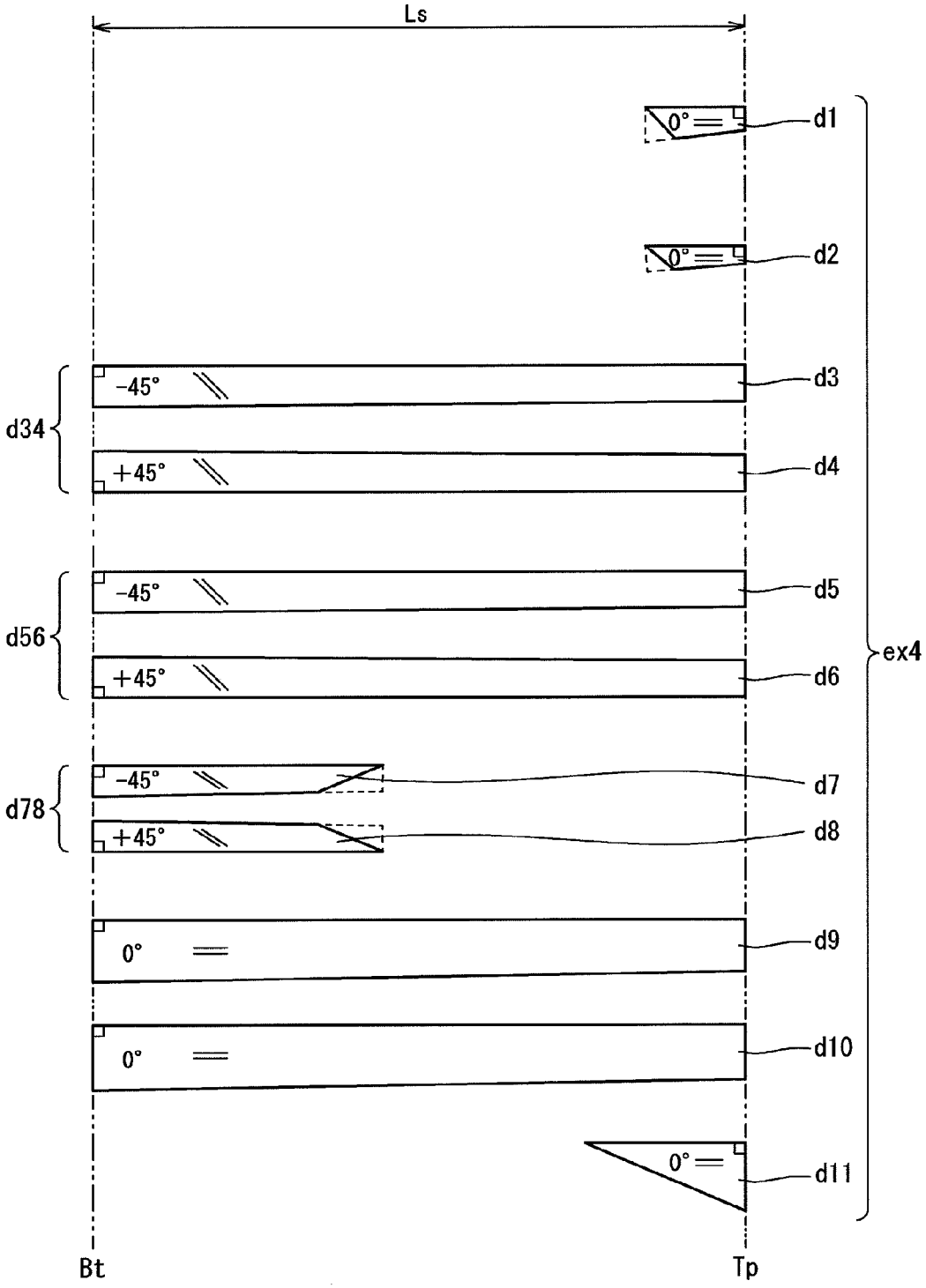
FIG. 5 is a developed view of a shaft of example 4.

FIG. 5 is a developed view of a shaft ex4 of example 4. Prepregs and PLY numbers (number of windings) used in the example 4 are shown in the following Table 5. A shaft and a club according to example 4 were obtained in the same manner as in the example 1 except for above. The specifications of the shaft and the club are shown in the following Table 10. In the example 4, a distance L1 was set to 0 mm, and a distance L2 was set to 535 mm.

TABLE 5

| Prepreg constitution of example 4 | | | |
|---|---|---|---|
| Sheet | Part number | | PLY number |
| d1 | TR350C | 150S | 3 |
| d2 | 2275S | 10 | 1 |
| d3 | E5526D | 10H | 2 |
| d4 | E5526D | 10H | 2 |
| d5 | HRX350C | 110S | 2 |
| d6 | HRX350C | 110S | 2 |
| d7 | TR350C | 100S | 1 |
| d8 | TR350C | 100S | 1 |
| d9 | MRX350C | 125S | 2 |
| d10 | MRX350C | 150S | 2 |
| d11 | TR350C | 125S | 4 |

Example 5

Figure 6:
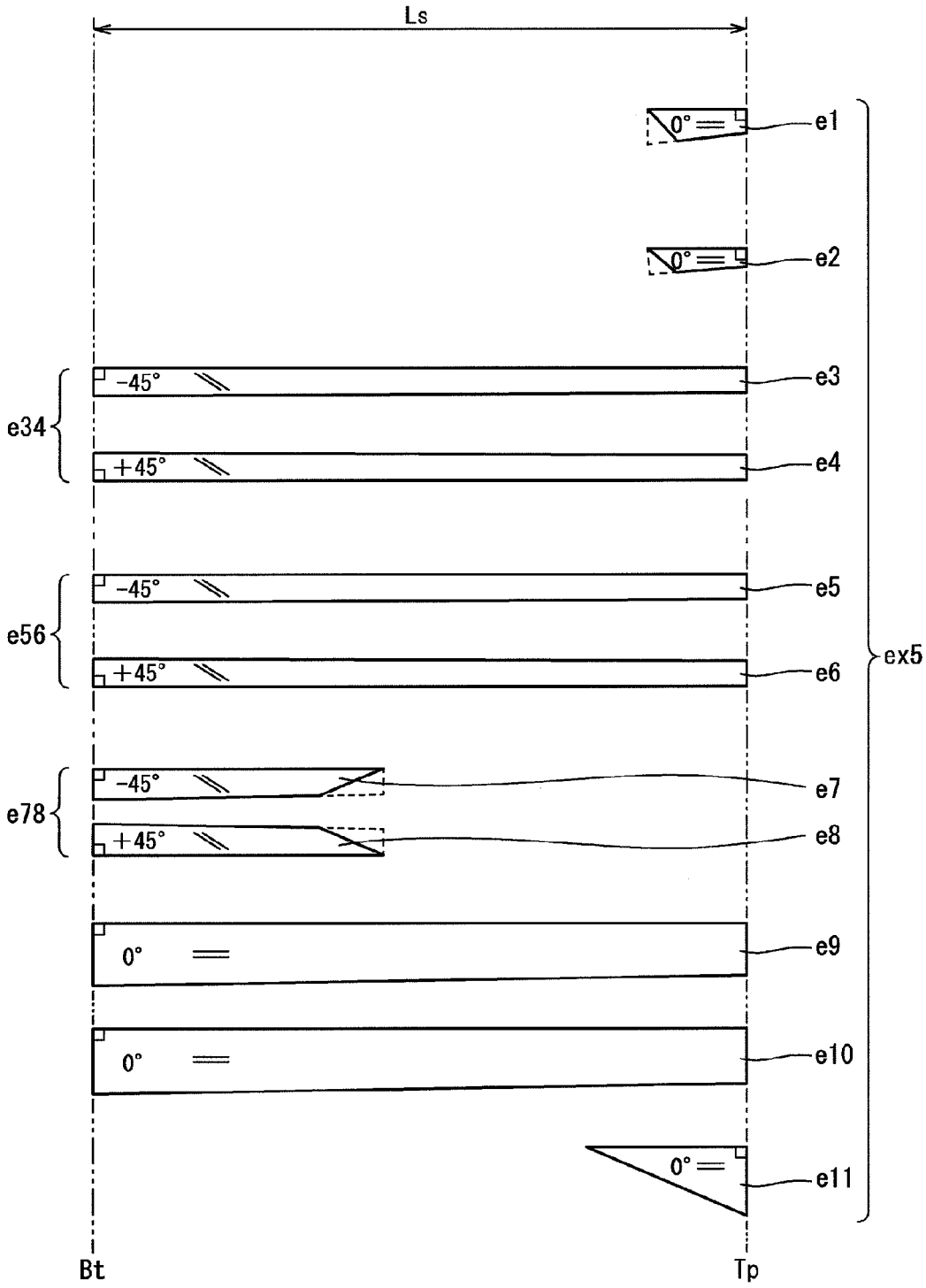
FIG. 6 is a developed view of a shaft of example 5.

FIG. 6 is a developed view of a shaft ex5 of example 5. Prepregs and PLY numbers (number of windings) used in the example 5 are shown in the following Table 6. A shaft and a club according to example 5 were obtained in the same manner as in the example 1 except for above. The specifications of the shaft and the club are shown in the following Table 10. In the example 5, a distance L1 was set to 0 mm, and a distance L2 was set to 535 mm.

TABLE 6

| Prepreg constitution of example 5 | | | |
|---|---|---|---|
| Sheet | Part number | | PLY number |
| e1 | TR350C | 150S | 3 |
| e2 | 2275S | 10 | 1 |
| e3 | E5526D | 10H | 1 |
| e4 | E5526D | 10H | 1 |
| e5 | HRX350C | 130S | 1 |
| e6 | HRX350C | 130S | 1 |
| e7 | TR350C | 100S | 1 |
| e8 | TR350C | 100S | 1 |
| e9 | MRX350C | 100S | 3 |
| e10 | MRX350C | 100S | 3 |
| e11 | TR350C | 150S | 4 |

Comparative Example 1

Figure 7:
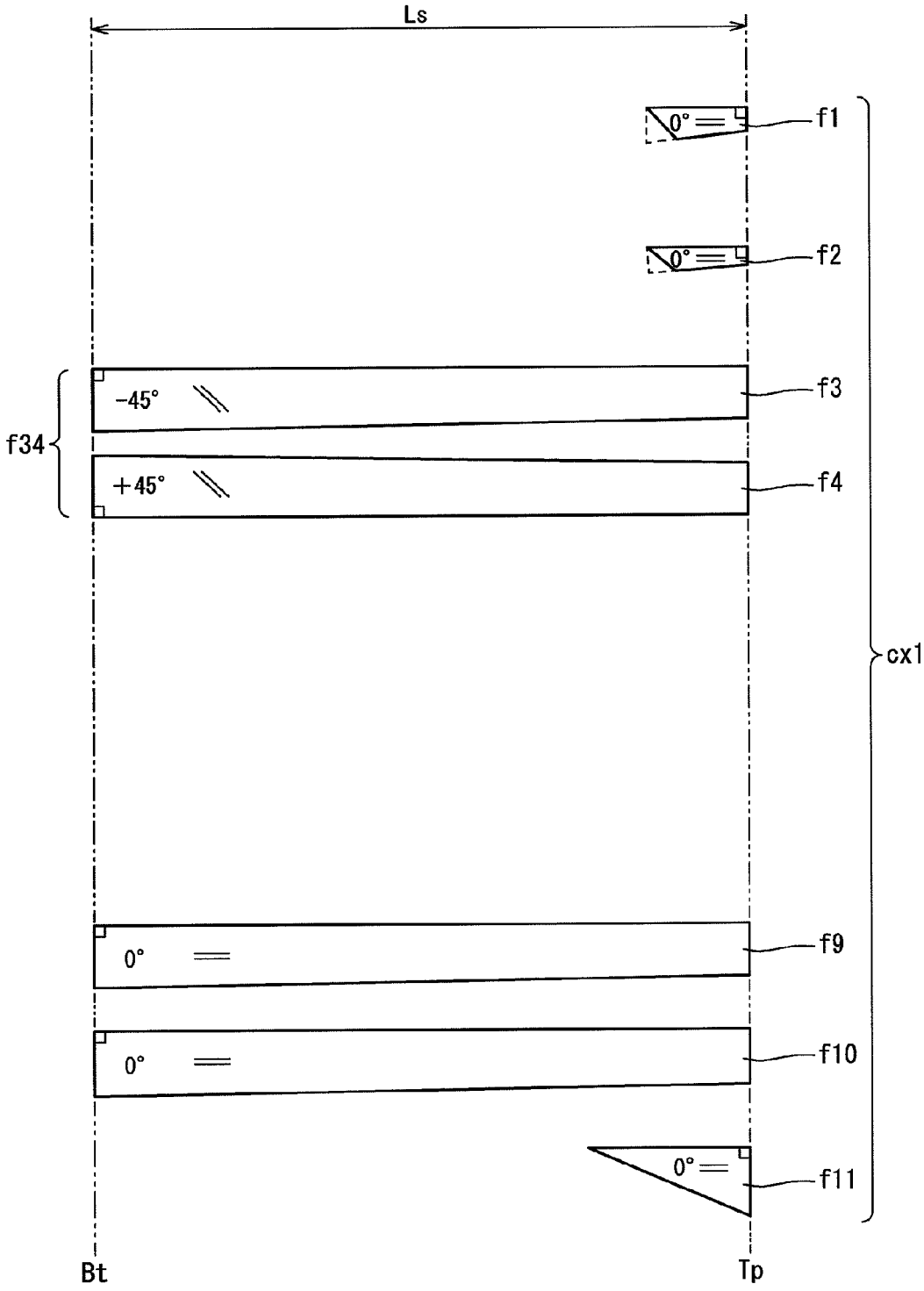
FIG. 7 is a developed view of a shaft of comparative example 1.

FIG. 7 is a developed view of a shaft cx1 of comparative example 1. Prepregs and PLY numbers (number of windings) used in the comparative example 1 are shown in the following Table 7. A shaft and a club according to comparative example 1 were obtained in the same manner as in the example 1 except for above. The specifications of the shaft and the club are shown in the following Table 11. As shown in FIG. 7, in the comparative example 1, the number of bias layer pairs is only 1.

TABLE 7

| Prepreg constitution of comparative example 1 | | | |
|---|---|---|---|
| Sheet | Part number | | PLY number |
| f1 | TR350C | 150S | 3 |
| f2 | 2275S | 10 | 1 |
| f3 | HRX350C | 110S | 3 |
| f4 | HRX350C | 110S | 3 |
| — | — | — | — |
| — | — | — | — |
| — | — | — | — |
| — | — | — | — |
| f9 | MRX350C | 125S | 2 |
| f10 | MRX350C | 150S | 2 |
| f11 | TR350C | 125S | 5 |

Comparative Example 2

Figure 8:
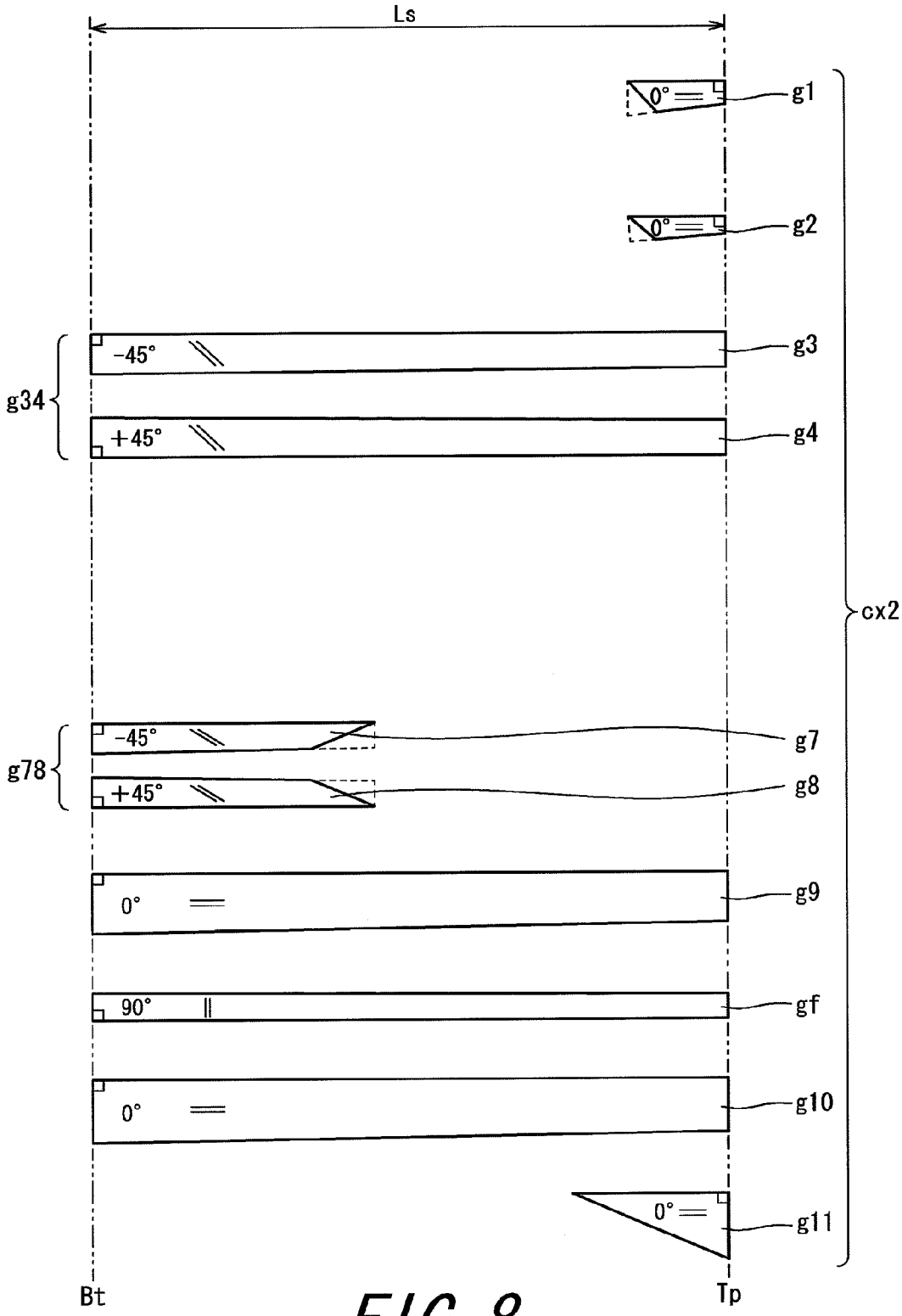
FIG. 8 is a developed view of a shaft of comparative example 2.

FIG. 8 is a developed view of a shaft cx2 of comparative example 2. Prepregs and PLY numbers (number of windings) used in the comparative example 2 are shown in the following Table 8. A sheet gf is a hoop layer. A shaft and a club according to comparative example 2 were obtained in the same manner as in the example 1 except for above. The specifications of the shaft and the club are shown in the following Table 11. As shown in FIG. 8, in the comparative example 2, the number of bias layer pairs is 2. One of these is a full length bias layer pair g34, and the other is a butt bias layer pair g78. In the comparative example 2, a distance L1 was set to 0 mm, and a distance L2 was set to 535 mm.

TABLE 8

| Prepreg constitution of comparative example 2 | | | |
|---|---|---|---|
| Sheet | Part number | | PLY number |
| g1 | TR350C | 150S | 3 |
| g2 | 2275S | 10 | 1 |
| g3 | HRX350C | 075S | 2 |
| g4 | HRX350C | 075S | 2 |
| — | — | — | — |
| — | — | — | — |
| g7 | TR350C | 100S | 1 |
| g8 | TR350C | 100S | 1 |
| g9 | MRX350C | 100S | 3 |
| gf | 805S | 3 | 1 |

TABLE 8-continued

| Prepreg constitution of comparative example 2 | | | |
|---|---|---|---|
| Sheet | Part number | | PLY number |
| g10 | MRX350C | 100S | 3 |
| g11 | TR350C | 150S | 5 |

Comparative Example 3

Figure 9:
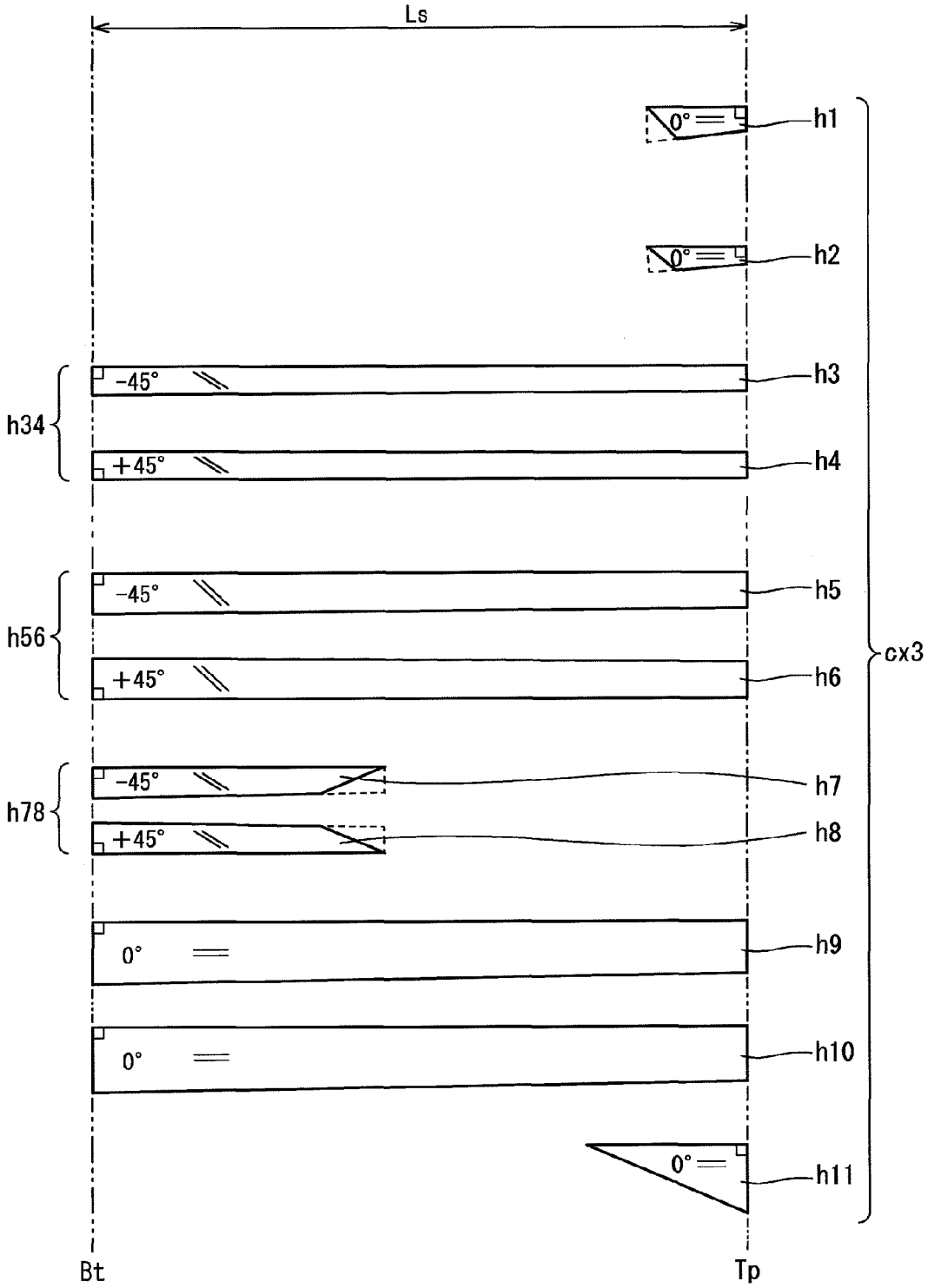
FIG. 9 is a developed view of a shaft of comparative example 3.

FIG. 9 is a developed view of a shaft cx3 of comparative example 3. Prepregs and PLY numbers (number of windings) used in the comparative example 3 are shown in the following Table 9. A shaft and a club according to the comparative example 3 were obtained in the same manner as in the example 1 except for above. The specifications of the shaft and the club are shown in the following Table 11. As shown in FIG. 9, the laminated constitution of the comparative example 3 is the same as that of the example 3 except for the product class of a second butt bias layer pair. In the example 3, the full length bias layer pair c56 is the pitch-containing bias layer pair. Meanwhile, in the comparative example 3, a full length bias layer pair h56 is a PAN-containing bias layer pair. The comparative example 3 has three bias layer pairs h34, h56, and h78. However, the comparative example 3 does not have the pitch-containing bias layer pair. In the comparative example 3, a distance L1 was set to 0 mm, and a distance L2 was set to 535 mm.

TABLE 9

| Prepreg constitution of comparative example 3 | | | |
|---|---|---|---|
| Sheet | Part number | | PLY number |
| h1 | TR350C | 150S | 3 |
| h2 | 2275S | 10 | 1 |
| h3 | HRX350C | 110S | 1 |
| h4 | HRX350C | 110S | 1 |
| h5 | HRX350C | 110S | 2 |
| h6 | HRX350C | 110S | 2 |
| h7 | TR350C | 100S | 1 |
| h8 | TR350C | 100S | 1 |
| h9 | MRX350C | 150S | 2 |
| h10 | MRX350C | 150S | 2 |
| h11 | TR350C | 125S | 5 |

TABLE 10

| Specifications and evaluation results of examples | | | | | | |
|---|---|---|---|---|---|---|
| | | Example 1 | Example 2 | Example 3 | Example 4 | Example 5 |
| Shaft | Shaft full length Ls [mm] | 1168 | 1168 | 1168 | 1168 | 1168 |
| | Position Lg of center of gravity of shaft [mm] | 645 | 666 | 646 | 661 | 631 |
| | Lg/Ls | 0.55 | 0.57 | 0.55 | 0.57 | 0.54 |
| | Shaft weight Ws [g] | 72 | 72 | 72 | 83 | 62 |
| | Torque [deg] | 3.4 | 4.0 | 3.3 | 2.7 | 3.9 |
| | GIt[N · m$^2$] | 7.10 | 5.79 | 7.15 | 7.10 | 5.98 |
| | GIb[N · m$^2$] | 42.94 | 33.42 | 43.71 | 52.71 | 30.60 |
| | GIb/GIt | 6.05 | 5.77 | 6.11 | 7.43 | 5.11 |
| | Out-plane primary attenuation rate | 0.51 | 0.52 | 0.95 | 0.55 | 0.48 |
| Club | Weight [g] | 323 | 326 | 323 | 333 | 313 |
| | Balance [14-inch type] | D2 | D2 | D2 | D2 | D2 |
| | Grip end MI [g · cm$^2$] · 10$^3$ | 2965 | 2960 | 2968 | 2972 | 2966 |
| | Head weight [g] | 201 | 204 | 201 | 201 | 201 |
| Actual hitting test | Flight distance [yds] | 258 | 262 | 259 | 260 | 259 |
| | Directional stability | 4.0 | 3.7 | 3.9 | 3.8 | 3.5 |
| | Vibration absorbability | 3.1 | 3.0 | 4.0 | 3.1 | 2.8 |

TABLE 11

| Specifications and evaluation results of comparative examples | | | | |
|---|---|---|---|---|
| | | Comparative example 1 | Comparative example 2 | Comparative example 3 |
| Shaft | Shaft full length Ls [mm] | 1168 | 1168 | 1168 |
| | Position Lg of center of gravity of shaft [mm] | 625 | 621 | 645 |
| | Lg/Ls | 0.54 | 0.53 | 0.55 |
| | Shaft weight Ws [g] | 72 | 52 | 72 |
| | Torque [deg] | 4.5 | 5.0 | 4.0 |
| | GIt[N · m$^2$] | 6.99 | 4.90 | 6.17 |
| | GIb[N · m$^2$] | 33.32 | 21.95 | 29.60 |
| | GIb/GIt | 4.77 | 4.48 | 4.79 |
| | Out-plane primary attenuation rate | 0.49 | 0.46 | 0.47 |
| Club | Weight [g] | 320 | 302 | 322 |
| | Balance [14-inch type] | D2 | D2 | D2 |
| | Grip end MI [g · cm$^2$] · 10$^3$ | 2969 | 2962 | 2963 |
| | Head weight [g] | 198 | 200 | 201 |
| Actual hitting test | Flight distance [yds] | 255 | 256 | 253 |
| | Directional stability | 3.0 | 2.8 | 3.3 |
| | Vibration absorbability | 3.0 | 2.9 | 3.0 |

The same mandrel was used in all the examples and comparative examples.

[Evaluation Methods]

The evaluation methods are as follows.

[Shaft Torque]

A back end part of a shaft was nonrotatably fixed by a butt jig, and a tip part of the shaft was grasped by a tip jig capable of applying a torque. A torque Tr of 13.9 kgf·cm was allowed to act on a position which was 40 mm away from the tip Tp. A torsional angle (degree) of the shaft at the torque action position was defined as a shaft torque. A rotating speed of the tip jig when the torque Tr was loaded was set to be equal to or less than 130 degrees/min, and an axial length between the butt jig and the tip jig was set to 825 mm. When the shaft is deformed by the grasping of the tip jig or the butt jig, the shaft torque is measured with a core material or the like put in the shaft. The measured values are shown in Tables 10 and 11.

[Butt Side Torsional Rigidity Value GIb]

Figure 10:
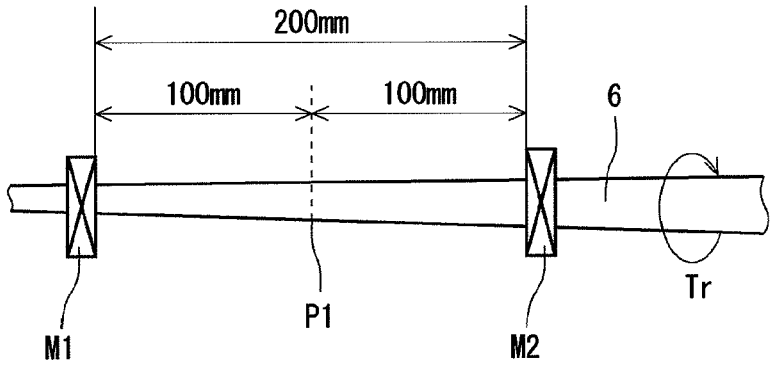
FIG. 10 shows a method for measuring torsional rigidity GI.

A GI value in a point P1 separated by 890 mm from the tip end Tp was measured. FIG. 10 shows a method for measuring a torsional rigidity value GIb. A first position was fixed by a jig M1, and a second position separated by 200 mm from the jig M1 was held by a jig M2. A measuring point P1 is an middle point between the first position and the second position. A torsion angle A (rad) of the shaft 6 when a torque Tr of 1.363 (N·m) was applied to the jig M2 was measured. The torsional rigidity value GIb was calculated by the following formula.

$$GIb(N\cdot m^2)=M\times Tr/A$$

M is a measuring span (m); Tr is a torque (N·m); and A is a torsion angle (rad). The measuring span M is 0.2 m, and the torque Tr is 1.363 (N·m). The torsional rigidity values GIb are shown in Tables 10 and 11.

[Torsional Rigidity GIt]

In the present application, a GI value in a point P1 separated by 90 mm from the tip end Tp was measured. Torsional rigidity GIt was measured as in the torsional rigidity value GIb except that the measuring span M was set to 100 mm and a measuring point was changed. Values ($N\cdot m^2$) of the torsional rigidity GIt are shown in Tables 10 and 11.

[Out-Plane Primary Attenuation Rate]

Figure 11:
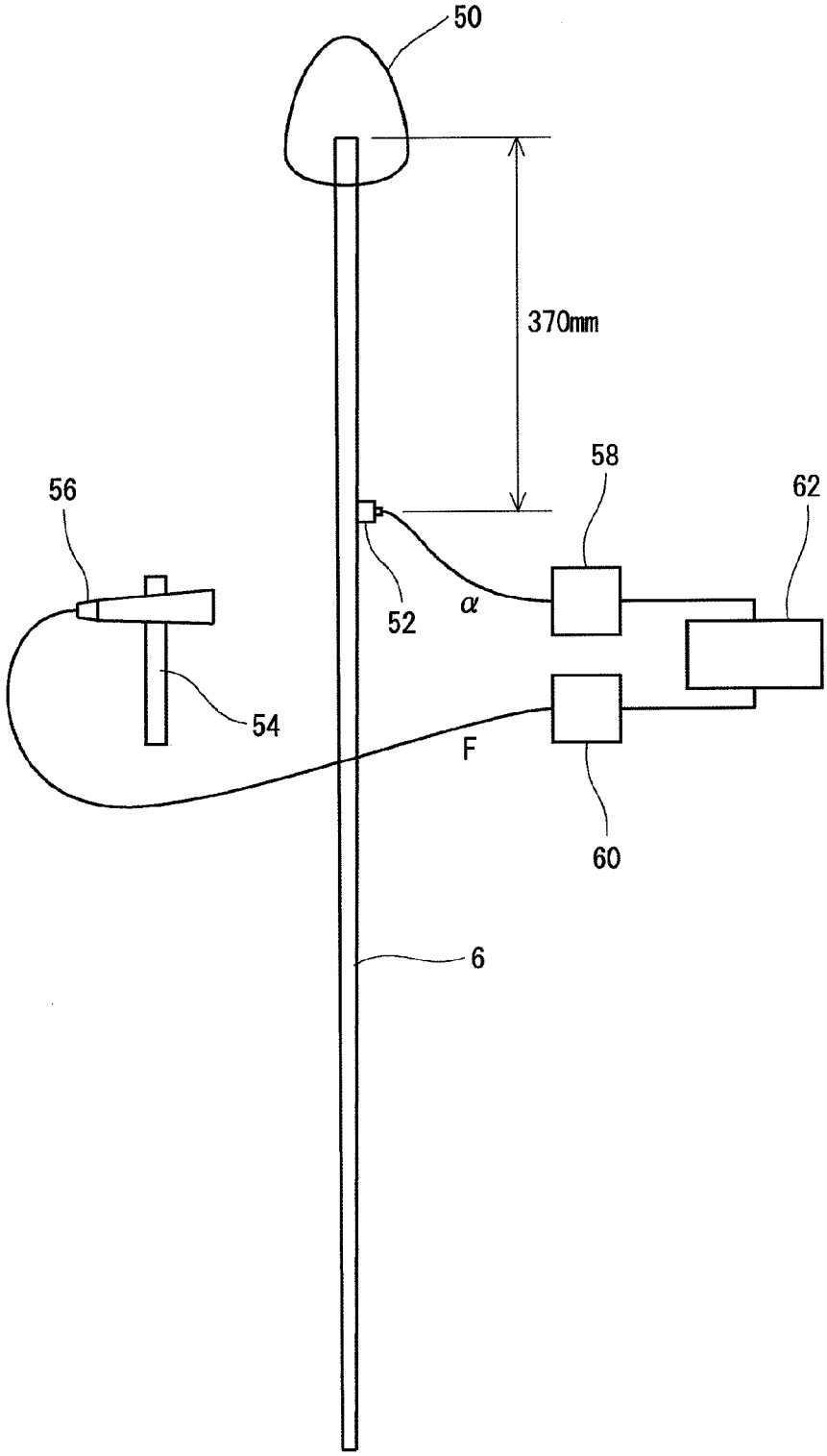
FIG. 11 shows a method for measuring an out-plane primary frequency.
Figure 12:
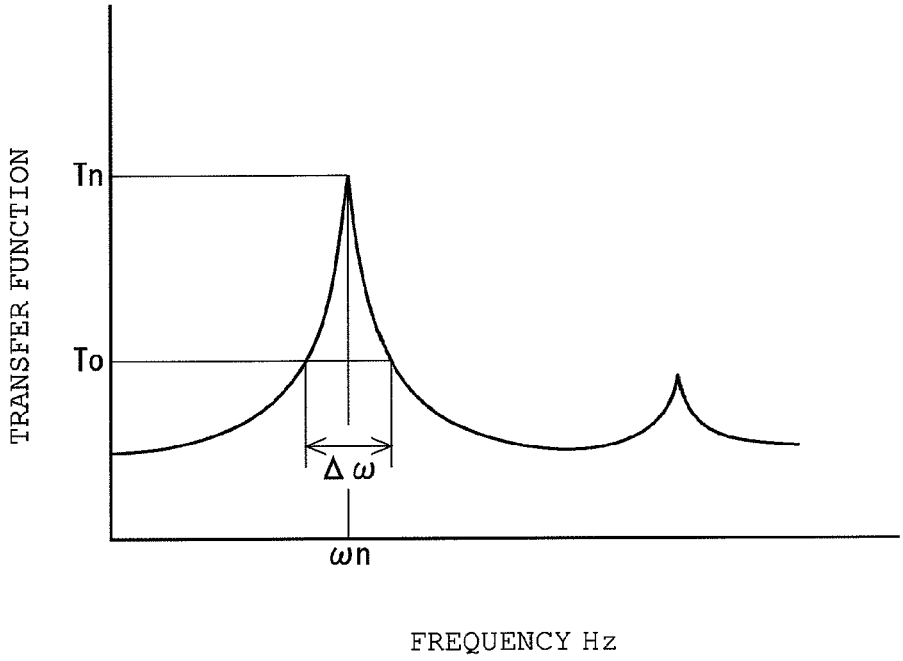
FIG. 12 is a graph showing an example of a transfer function obtained by measuring the out-plane primary frequency.

FIG. 11 shows a method for measuring an out-plane primary vibration attenuation rate. In the measurement, a string 50 is mounted to a butt side edge part of the shaft 6. An acceleration pickup meter 52 is mounted to a point separated by 370 mm from a grip end. The shaft 6 is hung by using the string 50. In a state where the shaft 6 is hung, the opposite side (back side) of the acceleration pickup meter 52 is hammered by an impact hammer 54 to excite the shaft 6. Input vibration F is measured by a force pickup meter 56 mounted to the impact hammer 54. Response vibration $\alpha$ is measured by the acceleration pickup meter 52. The response vibration $\alpha$ is input into a frequency analysis device 62 via an amplifier 58. The input vibration F is input into the frequency analysis device 62 via an amplifier 60. A dynamic single analyzer HP3562A manufactured by Hewlett Packard Company was used as the frequency analysis device 62. A transfer function in a frequency region obtained in analysis was determined to obtain a peak vibration number $\omega n$ of the shaft 6. FIG. 12 is a graph showing an example of the transfer function. A vibration attenuation rate $\zeta$ was determined by the following formula using the graph. The vibration attenuation rate $\zeta$ is an out-plane primary vibration attenuation rate. The values are shown in Tables 10 and 11.

$$\zeta=(1/2)\times(\Delta\omega/\omega n)$$

$$To=Tn\times 2^{1/2}$$

Tn is a peak value (maximum) of the transfer function; To is a value obtained by multiplying Tn by $\sqrt{2}$; and $\Delta\omega$ is a peak width when the transfer function is To (see FIG. 12).

[Grip End MI]

A rotation axis passing through the grip end (the back end of the club) and being perpendicular to the axis direction of the shaft is considered. The moment of inertia M1 ($g\cdot cm^2$) of the club around the rotation axis is calculated by the following formula. The moment of inertia MI is also referred to as a grip end MI in the present application.

$$MI=(T^2\cdot M\cdot g\cdot H)/4\pi^2$$

T is a pendulum motion cycle (second) with the grip end as a center; M is a club weight (g); H is a distance (cm) between the grip end and the center of gravity of the club; and g is a gravitational acceleration. The values are shown in Tables 10 and 11.

[Club Balance (Swing Balance)]

A 14-inch type club balance was measured by using "BANCER-14" (trade name) manufactured by DAININ Corporation. The values are shown in Tables 10 and 11.

[Flight Distance]

Actual hitting tests were conducted by 16 golf players having golf experience of at least 10 years and playing golf at least 4 times a month. Each of the golf players hit five balls, and a flight distance was measured based on the final reaching point of the ball. The average value of data of 16 golf players was calculated. The average values are shown in Tables 10 and 11.

[Directional Stability]

Questionnaire investigation was conducted on the 16 testers. The directional stability of the hit ball was evaluated at five stages of a one score to a five score. The higher the score is, the better the directional stability is. The average values of the evaluation scores of the 16 testers are shown in Tables 10 and 11.

[Vibration Absorbability]

Questionnaire investigation was conducted on the 16 testers. The vibration absorbability was evaluated at five stages of a one score to a five score. The higher the score is, the better the vibration absorbability is. The average values of the evaluation scores of the 16 testers are shown in Tables 10 and 11.

When the example 1 is contrasted with the comparative example 1, the flight distance and the directional stability are improved in the example 1 in which the torque is small and the center of gravity G of the shaft is located closer to the butt. In the example 2 in which the center of gravity G of the shaft is further located closer to the butt, the flight distance is further increased. The directional stability of the example 2 is inferior to that of the example 1. However, the directional stability of the example 2 is better than that of the comparative example 1. In the example 3, the out-plane primary attenuation rate and the vibration absorbability are improved. It is considered that this is because the PAN-containing bias layer pairs are disposed outside and inside the pitch-containing bias layer pair. In the examples 4 and 5, the shaft weight Ws is changed. In the examples 4 and 5, the flight distance is good because the center of gravity G of the shaft is located closer to the butt.

The advantages of the present invention are apparent from these results.

The present invention can be applied to all golf clubs.

The description hereinabove is merely for an illustrative example, and various modifications can be made in the scope not to depart from the principles of the present invention.

What is claimed is:

1. A golf club shaft, wherein when a shaft full length is defined as Ls and a distance between a tip end of the shaft and a center of gravity G of the shaft is defined as Lg, Lg/Ls is 0.54 or greater and 0.65 or less;

a shaft weight Ws is 50 g or greater and 85 g or less;

the golf club shaft has at least three bias layer pairs;

one bias layer pair of the three bias layer pairs is a pitch-containing bias layer pair having a pitch based carbon fiber; and two bias layer pairs of the three bias layer pairs are PAN-containing bias layer pairs having a PAN based carbon fiber.

2. The golf club shaft according to claim 1, wherein the PAN-containing bias layer pairs are located outside and inside the pitch-containing bias layer pair.

3. The golf club shaft according to claim 2, wherein the three bias layer pairs are brought into contact with each other.

4. The golf club shaft according to claim 1, wherein the one bias layer pair of the three bias layer pairs is a butt partial layer.

5. The golf club shaft according to claim 4, wherein the butt partial layer is the PAN-containing bias layer pair.

6. The golf club shaft according to claim 5, wherein the three bias layer pairs are brought into contact with each other.

7. The golf club shaft according to claim 4, wherein the two bias layer pairs of the three bias layer pairs are full length layers.

8. The golf club shaft according to claim 7, wherein the three bias layer pairs are brought into contact with each other.

9. The golf club shaft according to claim 7, wherein the number of the bias layer pairs is 3.

10. The golf club shaft according to claim 7, wherein the golf club shaft has one or more full length PAN-containing bias layer pairs and one or more full length pitch-containing bias layer pairs.

11. The golf club shaft according to claim 4, wherein the three bias layer pairs are brought into contact with each other.

12. The golf club shaft according to claim 4, wherein a distance L2 between a tip side end position of the butt partial layer and a butt end of the shaft is 300 mm or greater and 550 mm or less.

13. The golf club shaft according to claim 1, wherein the three bias layer pairs are brought into contact with each other.

14. The golf club shaft according to claim 1, wherein when a GI value in a point separated by 890 mm from the tip end of the shaft is defined as GIb, GIb is 24 $N \cdot m^2$ or greater and 59 $N \cdot m^2$ or less.

15. The golf club shaft according to claim 1, wherein when a GI value in a point separated by 90 mm from the tip end of the shaft is defined as GIt, GIt is 5.4 $N \cdot m^2$ or greater and 8.8 $N \cdot m^2$ or less.

16. The golf club shaft according to claim 1, wherein when a GI value in a point separated by 890 mm from the tip end of the shaft is defined as GIb, and a GI value in a point separated by 90 mm from the tip end of the shaft is defined as GIt, GIb/GIt is 5 or greater and 9 or less.

* * * * *